United States Patent [19]

Theurer et al.

[11] Patent Number: 4,576,538

[45] Date of Patent: Mar. 18, 1986

[54] BOX CAR

[75] Inventors: Josef Theurer, Vienna; Manfred Brunninger, Linz, both of Austria

[73] Assignee: Franz Plasser Bahnbaumaschinen-Industriegesellschaft m.b.H., Vienna, Austria

[21] Appl. No.: 523,125

[22] Filed: Aug. 15, 1983

[30] Foreign Application Priority Data

Sep. 23, 1982 [AT] Austria ..... 3554/82
Mar. 11, 1983 [AT] Austria ..... 879/83

[51] Int. Cl.[4] ..... B65G 67/00

[52] U.S. Cl. ..... 414/339; 414/528; 104/2

[58] Field of Search ..... 414/339, 340, 345, 528, 414/293, 300, 267, 268, 521; 198/347; 104/2

[56] References Cited

U.S. PATENT DOCUMENTS

| | | | |
|---|---|---|---|
| 1,920,500 | 8/1933 | Garcia et al. | 414/339 X |
| 2,637,457 | 5/1953 | Barrett | 414/528 |
| 3,033,393 | 5/1962 | Wesson | 414/300 |
| 3,578,183 | 5/1971 | Larger | 414/293 |
| 3,842,994 | 10/1974 | Theurer et al. | 414/339 |

FOREIGN PATENT DOCUMENTS

| | | | |
|---|---|---|---|
| 90348 | 12/1922 | Austria . | |
| 70091 | 11/1940 | Czechoslovakia . | |
| 1580970 | 3/1971 | Fed. Rep. of Germany . | |
| 2146590 | 3/1972 | Fed. Rep. of Germany . | |
| 2258385 | 6/1974 | Fed. Rep. of Germany . | |
| 1920857 | 2/1977 | Fed. Rep. of Germany . | |
| 730300 | 5/1955 | United Kingdom | 414/528 |

*Primary Examiner*—Joseph E. Valenza
*Assistant Examiner*—David A. Bucci
*Attorney, Agent, or Firm*—Kurt Kelman

[57] ABSTRACT

A box car for storing bulk material and useful for incorporation in a freight train preceding a ballast cleaning machine for transporting waste material coming from the machine, the box car comprising a frame defining a plane, a box open on top and mounted on the frame for storing the bulk material, and a conveyor band arrangement in a lower portion of the box and extending in the direction of elongation of the box car. The conveyor band arrangement has a width substantially equal to that of the lower box portion and comprises a first portion extending in the plane and an ascending portion extending in this direction from the first portion of the conveyor band arrangement beyond the frame, a drive for the conveyor band arrangement, and a bulkhead partition in the box, the bulkhead partition being displaceable in this direction for dividing the box into compartments. The bulkhead partition has a lower end defining a port with the first conveyor band arrangement portion.

14 Claims, 8 Drawing Figures

35
36
37
38
39
40
41
42
43
44
45
46
47
48
49
50
51
53
54
55
56
57
58
59
60
61
62
63
64
65
66
68
69
70
VII
VIII

BOX CAR

The present invention relates to a box car for storing bulk material and useful for incorporation in a freight train preceding a ballast cleaning machine for transporting waste material coming from the machine. Such box cars comprise a frame defining a plane and a box open on top and mounted on the frame for storing bulk material.

U.S. Pat. No. 3,842,994, dated Oct. 22, 1974, discloses a box car of this type with a funnel-shaped box. Two driven conveyor bands are arranged in an upper portion of the box for conveying the bulk material and these conveyor bands are relatively displaceable along guides in the side walls of the box in the direction of elongation of the box car. In this manner, the entire length of the car may be covered by the conveyor bands for conveying the bulk material to an adjacent box car. For loading the car, one of the conveyor bands may also be moved under the other conveyor band so that the car may be uniformly loaded by reversing the conveying direction. Discharge chutes are arranged in a lower portion of the box side walls for unloading the car. These box cars have been successfully used commercially but the conveyor band structure is relatively expensive and the displacement of the conveyor bands is not always trouble-free.

Published German patent application No. 2,146,590 discloses a box car of the first-described type and useful in track rehabilitation and renewal operations, with a funnel-shaped box whose lower portion is comprised of two funnels each defining a discharge opening. A conveyor band arrangement is mounted immediately below each discharge opening. Each conveyor band arrangement extends transversely of the direction of elongation of the box car and is laterally displaceable, the width of each conveyor band being limited to that of the relatively narrow discharge opening. For unloading the bulk material, for example ballast, from the car, the conveyor band arrangement is extended to one side and this conveyor band arrangement delivers the ballast discharged through the opened discharge opening to the adjacent track which is being rehabilitated or renewed. Two conveyor bands extending in the direction of elongation are arranged in the range of top opening of the box, which is constricted by the inwardly inclined box walls, for charging the box car with the bulk material, one of the charging conveyor bands being displaceable and having a width corresponding to about a third of the width of the box car at its widest portion. While this structure enables the box car to be automatically loaded and unloaded, the funnel-shaped box has a relatively complex and expensive structure and full loading of the car is impossible since free spaces will always be left therein. The provision of four conveyor bands per car further increases the cost of this installation.

It is the primary object of the present invention to provide a box car of the first-indicated type with a relatively simple structure for automatically loading and unloading the bulk material completely and uniformly.

The above and other objects are accomplished according to this invention with a conveyor band arrangement in a lower portion of the box and extending in the direction of elongation of the box car. The conveyor band has a width substantially equal to that of the lower box portion and comprises a first portion extending in the plane and an ascending portion extending in said direction from the first portion of the conveyor band arrangement beyond the frame. The conveyor band arrangement has a drive means and a bulkhead partition in the box is displaceable in said direction for dividing the box into compartments. The bulkhead partition has a lower end defining a port with the first conveyor band arrangement portion.

The two portions may be constituted by a single conveyor band or by two sequentially arranged, partially overlapping conveyor bands.

While the structure of such a box car is simple, it is also robust and requires only a single driven conveyor band arrangement for automatically and completely loading and unloading the car. The use of a conveyor band having substantially the same width as the lower box portion through which it passes makes it possible uniformly and fully to load as well as to unload completely even a box with substantially perpendicular side walls, which is much more economical to manufacture than funnel-shaped or hopper-like boxes. The box car of the invention has the additional advantage that it requires no auxiliary means, such as discharge ports, chutes, discharge conveyors or the like, for unloading the bulk material. The economy of such a box car is further enhanced when used in a train for storing and transporting the waste or rubble coming from a ballast cleaning operation, in which a great number of such box cars of the same structure and function are required. It may be noted, additionally, that the dependable operation of the conveyor band is further assured because it is not displaceably mounted. The continuous division of the box by the displaceable bulkhead partition into compartments makes it possible to effect economical, uniform, complete and rapid loading and unloading with a fixed inlet for the bulk material.

The above and other objects, advantages and features of the present invention will become more apparent from the following detailed description of a now preferred embodiment thereof, taken in conjunction with the accompanying, somewhat schematic drawing wherein FIG. 1 is a side elevational view of a freight train coupled to a ballast cleaning machine and comprised of a plurality of box cars for storing and transporting the waste or rubble coming from the ballast cleaning machine;

Figure 1:
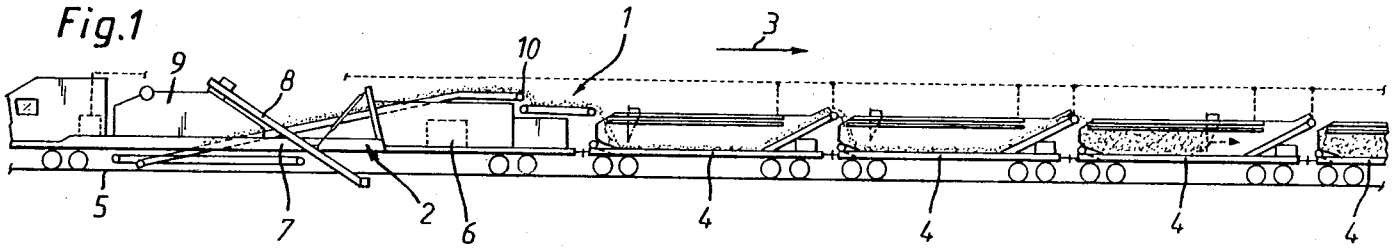

Referring now to the drawing and first to FIG. 1, there is shown freight train 1 coupled to ballast cleaning machine 2 and preceding the machine in the operating direction indicated by arrow 3. The train comprises a plurality of like box cars 4 and the ballast cleaning machine and box cars move on track 5. Ballast cleaning machine 2, which may be entirely conventional, is self-propelled, drive 6 for the machine being mounted on machine frame 7 which also carries ballast excavating and conveying arrangement 8 and ballast screening installation 9 receiving the excavated ballast therefrom. The cleaned ballast coming from screening installation 9 is redistributed by a conventional system of laterally pivotal ballast distributing conveyor bands and the waste or rubble coming from installation 9 is removed from the machine by waste removal conveyor arrangement 10, all of this structure being entirely conventional.

Figure 2:
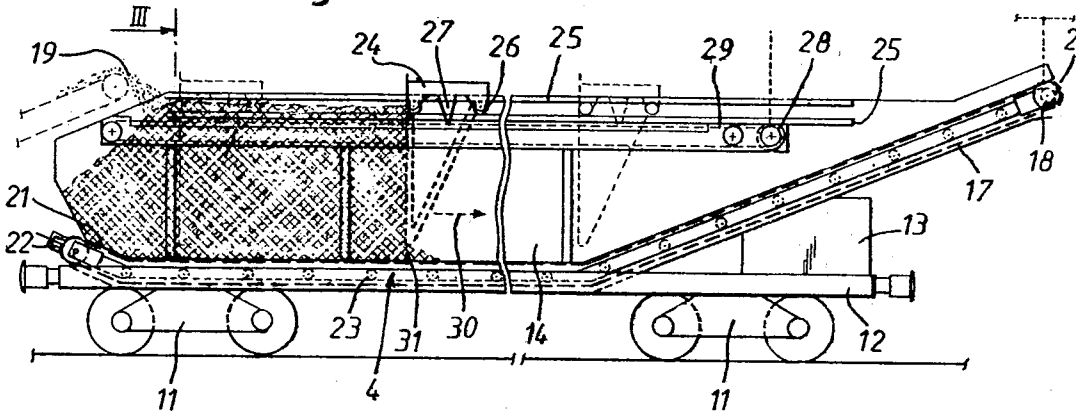
FIG. 2 is an enlarged side elevational view of a box car.
Figure 3:
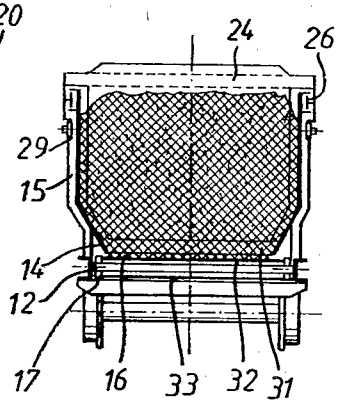
FIG. 3 is a cross sectional view of the box car along line III of FIG. 2.

One of the box cars 4 incorporating the structure of this invention is shown in FIGS. 2 and 3. Box car 4 comprises frame 12 defining a plane and carried by undercarriages 11, 11 running on track 4. Power plant 13 is mounted on car frame 12 for supplying power to the various drives to be described hereinafter. As clearly shown in FIG. 3, box 14 open on top and at the bottom is mounted on frame 12 for storing bulk material, i.e. the waste or rubble coming from conveyor arrangement 10. Lateral braces 15 support box 14 on frame 12. The conveyor arrangement is constituted by two portions of single conveyor band 17 arranged in a lower portion of box 14 and extends in the direction of elongation of box car 4. The conveyor band in the illustrated embodiment is arranged immediately below the open bottom of box 14 and forms a bottom wall of the box. This construction is very economical because it requires only side walls for the box. Since the bottom opening is covered completely by conveyor band 17 having a width substantially equal to that of the lower box portion or bottom opening, the bulk material delivered into box 4 will be received therein without any problem. Furthermore, this arrangement makes it possible to make conveyor band 17 a little wider than the bottom opening so that its longitudinal edge portions extend outside of the bottom opening to avoid contamination and increased wear of the conveyor band bearings.

In the illustrated embodiment, open box bottom 16 has an obliquely ascending end portion extending in the direction of elongation of box car 4 to an upper edge of box 14 and conveyor band 17 comprises a first portion extending in the plane and a correspondingly ascending end portion extending in this direction from the first portion of the conveyor band and projecting beyond the frame, the ascending conveyor band end portion forming a bottom wall of the ascending open box bottom end portion. The first, horizontal portion in the frame plane is illustrated as extending over substantially half the length of the box car. This structure makes it possible to use conveyor band 17 without any additional means for loading a like box car coupled to box car 4 and adjacent thereto. Therefore, a considerable number of such box cars may be coupled together to form a train for storing and transporting the waste or rubble coming from ballast cleaning machine 1.

The illustrated conveyor band is a chain conveyor with closely adjacent chain links and moved by driven pulley 18 over which the conveyor driving chain is trained to convey the bulk material to an output end 20 for unloading the bulk material from box car 4. End portion 21 of open box bottom 16 and of conveyor band 17 opposite to the ascending end portion form short portions descending to the plane of frame 12 to provide a gliding zone for the bulk material delivered into the box car from output 19 of a preceding bulk material conveyor, i.e. conveyor arrangement 10 for the first box car 4 coupled to ballast cleaning machine 2 or conveyor band 17 of a preceding box car for the succeeding cars of freight train 1. This short gliding zone has the advantage of enabling the bulk material delivered into box car 4 from output 19 to be steadily and easily detached from the adjacent end wall of box 14 for movement into the interior of the box car. In this manner, the compartment formed by displaceable bulkhead partition 24 is automatically and rapidly filled with the bulk material.

The chain links of conveyor band 17 glide on rollers 23 rotatably mounted on car frame 12 and tensioning device 22 is provided at an end of the conveyor chain opposite to driven pulley 18 for tensioning the chain. For continuously dividing box 14 into compartments, bulkhead partition 24 is displaceable in box 14 in the direction of elongation of the box car. The box has two side walls extending in this direction and, in the illustrated embodiment, respective guide rails 25 along the side walls are affixed thereto. The bulkhead partition has at least two guide rollers 26 running along each guide rail 25 for displacing the bulkhead partition in this direction. Cable drive 29 including drive 28 is connected to guide arm 27 of bulkhead partition 24 for displacing the bulkhead partition along the guide rails. Cable drive 28 as well as conveyor drive 18 are connected by control lines to a central control station of ballast cleaning machine 2, as schematically indicated in broken lines in FIG. 2. This disposition of the displaceable bulkhead partition assures a simple mounting thereof, enabling the bulkhead partition to withstand the difficult operating conditions to which it is subjected. The cable drive may be remote-controlled to enable the bulkhead partition to be displaced in both directions. Furthermore, the speed of displacement of the bulkhead partition during the operation may be readily synchronized with the speed of the conveyor band for obtaining a uniform and full loading of the box car.

As indicated in broken lines in FIG. 2, bulkhead partition 24 is braced by an oblique wall at the side of the bulkhead partition opposite to the side facing the bulk material and is displaced during the loading operation in the direction indicated by arrow 30. The bulkhead partition has a lower end spaced from conveyor band 17 to define port 31 for the bulk material. This makes it possible continually to unload the box car when the bulkhead partition is held stationary while the conveyor band is moved whereby the bulk material discharged through port 31 is conveyed by conveyor band 17 to output 20. In this manner, the conveyor band may be used merely as an intermediate link of a conveyor path for loading a succession of box cars.

As shown in FIG. 3 in broken lines, bulkhead partition 24 may assume various positions in relation to box 14 and, if desired, small gaps may be left between the bulkhead partition and the side walls of the box. Conveyor band 17 gliding on rollers 23 has a conveying portion 32 adjacent bottom opening 16 of box 14 and portion 33 opposite thereto.

The box car described hereinabove may be operated in the following manner in conjunction with ballast cleaning machine 2 to form a freight train for storing and transporting waste and rubble coming from the ballast cleaning machine:

A plurality of box cars 4 are coupled together so conveyor output 20 of the cars is in front in the operating direction indicated by arrows 3 and 30. As soon as conveyor arrangement 10 begins to deliver waste or rubble to the first box car adjacent to ballast cleaning machine 2, all drives 18, except the one in foremost box car 4, are actuated from the central control station on the ballast cleaning machine to move conveyor bands 17 in all the box cars of train 1, except for the foremost car. In this manner, the conveyor bands form a continuous conveying path for the bulk material from machine 2 to the foremost box car, the bulk material being delivered into the successive box cars at input 19 at the rear of each car and being conveyed by conveyor band 17 to output 20 at the front of each car, whence it is delivered into the next succeeding car until it reaches the foremost car. The bulk material passes through port 31 in each car while being conveyed. In foremost box car 4, drive 18 for the conveyor band and drive 28 for the displacement of bulkhead partition 24 are operated synchronously so that conveyor band 17 advances with the bulkhead partition to advance the bulk material in the box car as the compartment defined by the bulkhead partition becomes larger in step with the displacement of the bulkhead partition. At the beginning of the loading operation, bulkhead partition 24 is in its rearmost end position adjacent input 19, as indicated in broken lines in FIG. 2, and during the loading operation, the bulkhead partition is advanced to its foremost end position at the end of the horizontal portion of the conveyor band, also indicated in broken lines in FIG. 2. In this manner, the compartment of the box car defined by bulkhead partition 24 can be completely filled in an economical manner up to the edge of box 14 without in any way changing input 19 or output 20. The speed of the common advancement of the bulkhead partition and the conveyor band is adapted to the amount of bulk material delivered at input 19 so that there is only a small conical surface of bulk material near the upper edge of the box. When the car is filled completely and uniformly, drives 18 and 28 are switched off, and the above-described procedure is repeated in the car rearwardly of the loaded box car, and so forth until all the cars have been loaded.

The cars may be automatically and rapidly unloaded by operating drives 18 of the conveyor bands only to move the bulk material through port 31.

While the described and illustrated embodiment shows an independent drive for the displacement of bulkhead partition 24, this may also be effected automatically with the movement of conveyor band 17 in the direction of arrow 30, a greater frictional resistance being imparted to guide rollers 26, for example by the interposition of a pawl or friction coupling. The bulkhead may then be manually returned to its original position. It would also be possible to mount conveyor band 17 on the bottom wall of a box open on top, rather than providing a box open at the bottom, with the conveyor band forming the bottom wall.

In the embodiment illustrated in FIGS. 4 to 8, the two conveyor band arrangement portions are constituted by two sequentially arranged, partially overlapping conveyor bands 53, 54 and the drive means for the conveyor band arrangement comprises a respective drive 58, 59 for each conveyor band. The sequential arrangement of two conveyor bands forming the conveyor band arrangement, which are stationarily fixed and are driven each by its own drive, assures rapid loading and unloading as a high conveying efficiency and highly dependable operation. Loading requires the operation of only one conveyor band so that wear is considerably reduced. The partial overlapping of the two conveyor bands enables the bulk material to be unloaded with the two conveyor bands without any interruption in the conveying path.

Figures 4, 5, 6:
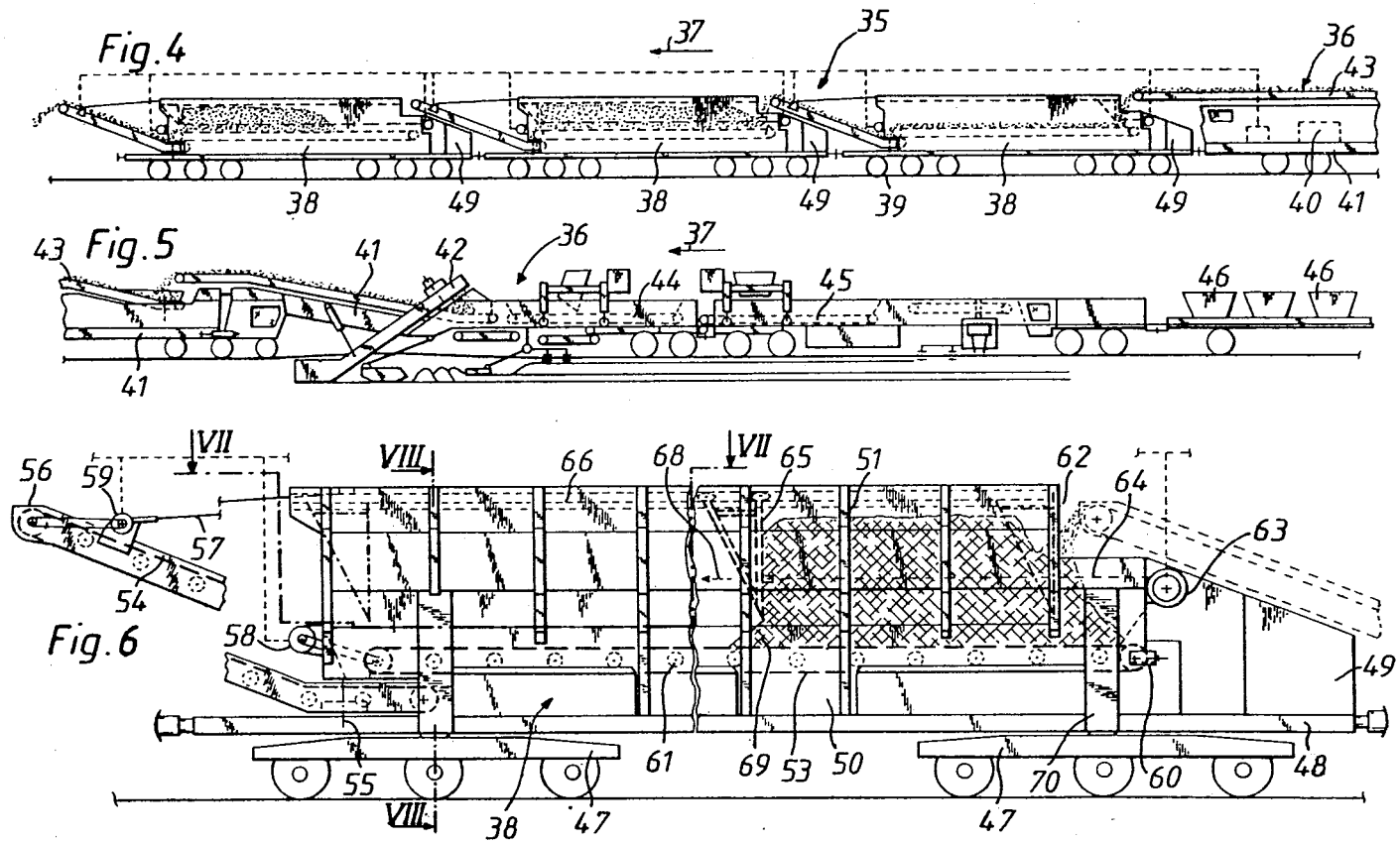
FIG. 4 is a side elevational view of part of such a freight train coupled to a ballast cleaning machine for the continuous rehabilitation of a ballast bed.
FIG. 5 shows a remaining part of this freight train and is a continuation of FIG. 4.
FIG. 6 is similar to FIG. 2 and shows another embodiment of the box car.

As shown in FIGS. 4 and 5, installation 36 for the continuous rehabilitation of a track bed comprises freight train 35 preceding a ballast cleaning machine for transporting waste material coming from the machine. The installation is mounted for mobility on track 39 in the direction of arrow 37 and comprises a plurality of box cars 38 for storing the waste material. The installation is moved along the track by drive 40 mounted on the ballast cleaning machine which comprises frame 41, endless ballast excavating conveyor chain 42 and waste material removal conveyor 43 receiving the waste material from the chain. Sand and ballast transport arrangements 44, 45 are coupled to the rear of the ballast cleaning machine for supplying sand and new ballast thereto, followed by a series of freight cars carrying containers 46 storing sand and ballast.

Figure 7:
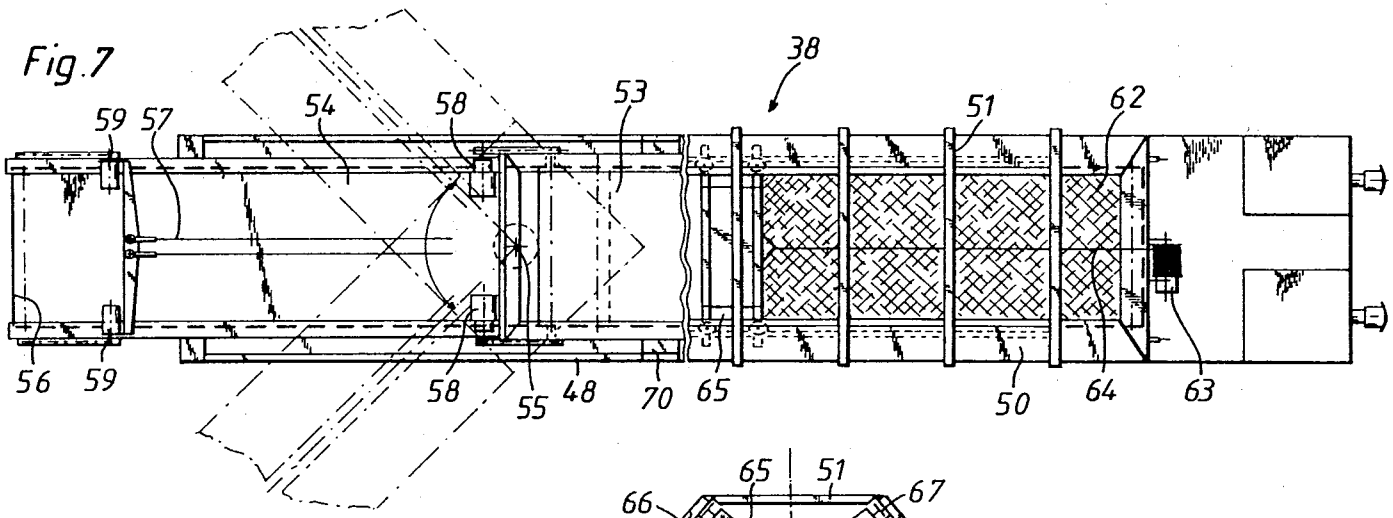
FIG. 7 is a top view of FIG. 7.
Figure 8:
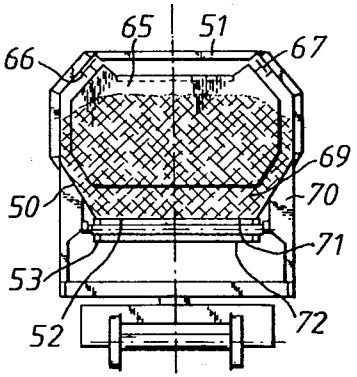
FIG. 8 is a transverse section along line VIII—VIII of FIG. 6.

As shown in FIGS. 6 to 8, each box car 38 comprises frame 48 defining a plane and supported on undercarriages 47 for mobility on the track. Power supply 49 delivering energy to the various drives to be described hereinafter is mounted on box car frame 48. Box 50 open on top is mounted on the frame for storing the bulk, i.e. waste, material coming from the ballast cleaning machine. A series of reinforcing elements 51 extend transversely to the direction of elongation over the open top of box 50 between the side walls of the box to brace the same. Such a bracing arrangement consisting of integral elements imparts optimal solidity and rigidity to the boxes under the high pressures exerted on the side walls when the boxes are completely filled with heavy bulk material even if the side walls are relatively thin.

Box 50 is open at the bottom and the conveyor band arrangement of this embodiment is constituted by two partially overlapping conveyor bands 53, 54, conveyor band 53 and an overlapping portion of the other conveyor band 54 being arranged immediately below open bottom 52 of the box and forming a bottom wall of the box. With this conveyor band arrangement, the manufacture of box 50 requires only side walls and since the major portion of open box bottom 52 is covered by conveyor band 53, the entire waste material is received in the box without any difficulty for loading the box without operation of conveyor band 54. On the other hand, since the overlapping end portion of conveyor band 54 covers the remaining portion of open box bottom 52, the box may be readily unloaded by operation of conveyor band 54 without requiring controls which are subject to break-downs. The conveyor bands may be a little wider than open bottom box 52 so that their longitudinal edges will extend outside box 50 and thus avoid being fouled and subjected to undue wear at the points of their mounting.

Conveyor band 54 has an end overlapping other conveyor band 53 and the overlapping conveyor band end is positioned below conveyor band 53, conveyor band 54 constituting the ascending portion of the conveyor band arrangement having an end opposite the overlapping end projecting beyond frame 48 of the box car. Pivot 55 extends perpendicularly to the plane of the box car frame for rotatably mounting the overlapping conveyor band end on the frame. As shown in chain-dotted lines in FIG. 7, this enables conveyor band 54 to be laterally pivoted so that opposite end 56 of the conveyor band, which extends to, or above, the height of the box, may discharge the waste material either centrally to another box car or laterally adjacent the box car at a selected side thereof without in any way interfering with the conveyance of the material. In this manner, the box cars may be unloaded in critical track sections (for example in curves) without interrupting the advancement of the installation along the track and while the loading operation continues unhindered.

As shown in FIG. 6, the portion of conveyor band 54 adjacent the overlapping end portion and extending outside of box 50 ascends from the overlapping end portion and ropes or cable 57 connect discharge end 56 of conveyor band 54 to box 50 to hold the same in position. A respective drive 58, 59 is provided for each conveyor band consisting of a conveyor chain with closely adjacent chain links. Conveyor band 53 and the overlapping end portion of conveyor band 54 are arranged in a lower portion of the box and extend in the direction of elongation of the box car. The conveyor band arrangement has a width substantially equal to that of the lower box portion, extending slightly beyond the width of open box bottom 52. The chain links of conveyor band 53 are glidably supported on freely rotatable rollers 61 journaled in frame 48. Tensioning device 60 is arranged for holding the chain links under tension. Box 50 defines a recessed end constituting an inlet for the waste material coming from the ballast cleaning machine.

Bulkhead partition 65 in box 50 is displaceable in the direction of elongation of box car 38 by cable drive 63 arranged centrally in the recessed end of box 50 and comprising cable 64 attached to the bulkhead partition for dividing the box into compartments. The bulkhead partition has a lower end defining port 69 with conveyor band 53 which forms the first conveyor band arrangement portion. Longitudinal guide means is provided for the displacement of bulkhead partition 65 and a common power source 49 is connected to conveyor band drives 58, 59 and power drive 63 for the displacement of the bulkhead partition, the drives in this embodiment being hydraulic drives and the power source including a sump for hydraulic fluid connected to the drives by a hydraulic fluid circuit. This provides a dependable arrangement for the continuous operation of the apparatus, requiring a minimum of maintenance. Furthermore, depending on the amount of waste material coming from the ballast cleaning machine, it is possible to discharge material from each box car on the track shoulders, if desired.

FIG. 7 shows the entire length of conveyor band 54 with its discharge end 56, the conveyor band being pivotal over an angle of 45° about vertical pivot 55, as shown in the two positions indicated in chain-dotted lines. In every angular position, the overlapping end of conveyor band 54 remains below conveyor band 53 so that proper conveyance of the bulk material remains assured in all angular positions of conveyor band 54.

Bulkhead partition 65 may be displaced in the direction of elongation of box car 38 into various positions, as shown in chain-dotted lines in FIG. 6, the side edges of the bulkhead partition forming a small gap with the side walls of box 50. Lateral braces 70 support the box on frame 48. Conveyor band 53, which glides on rollers 61, is an endless band trained over two end pulleys and comprising upper course 71 positioned slightly below open box bottom 52 and lower course 72.

The installation illustrated in FIGS. 4 to 8 operates in the following manner:

A succession of box cars 38 are so coupled together that discharge end 56 of obliquely ascending conveyor band 54 is arranged forwardly in the direction indicated by arrow 68, which is the direction of advancement of the freight train as well as the direction of conveyance of the bulk material coming from the ballast bed rehabilitation installation 36 and its waste material conveyor 43. While the entire installation advances continuously along the track, ballast excavating and conveyor chain 42 removes the ballast from the bed for cleaning and sand and new ballast is delivered from conveyors 44 and 45 for rehabilitating the sub-grade and the ballast bed. The operation of such installations are well known and will not be described herein in detail.

As soon as waste material conveyor 43 discharges waste material into the first box car 38, drives 58, 59 for driving conveyor band arrangements 53, 54 of all but the foremost box cars of the freight train are operated by a central control. In this manner, the continuously delivered waste material is conveyed without interruption to foremost box car 38, discharge end 56 of each conveyor arrangement delivering the waste material into inlet 62 of each successive box car and the waste material being conveyed by each conveyor arrangement through port 69 between the bulkhead partition and the underlying conveyor band.

In foremost box car 38, only drive 58 for conveyor band 53 and drive 63 for bulkhead partition 65 are operated to drive the conveyor band and to displace the bulkhead partition in unison as box 50 is filled by the waste material delivered to the foremost box car. At the start, the bulkhead partition is in a rear end position adjacent inlet 62 so that it defines a limited compartment which may be readily loaded uniformly up to the upper edge of the box. As soon as this limited compartment has been filled, drives 58 and 63 are actuated for the continuous movement of conveyor band 53 and bulkhead partition 65 in the direction of arrow 68. The speed of the common movement of the conveyor band and bulkhead partition is adjusted to the delivered amount of waste material so that the waste material always forms a conical heap reaching to the upper edge of box 50, a shown in FIG. 6. As soon as the bulkhead partition has reached the opposite end position indicated in chain-dotted lines in FIG. 6, drives 58 and 63 are switched off because the box car has been fully and uniformly loaded. This procedure is now repeated in the immediately following box car by first disconnecting drive 59 for conveyor band 54, and so on until all the box cars have been loaded.

FIG. 4 shows the loading of this second box car while the foremost box car is unloaded by pivoting conveyor band 54 to the side and discharging the stored waste material on the track shoulders, bulkhead partition 65 remaining in its foremost position and both conveyor bands 53, 54 being moved so that the waste material is conveyed through port 69 from conveyor band 53 to conveyor band 54. After this box car has been unloaded, cable drive 63 is actuated to move the bulkhead partition backs to its rearmost position next to inlet 62 so that the box car is ready for a subsequent loading operation, as described hereinabove. If desired, a number of box cars may be unloaded in the above-described manner simultaneously to expedite the operation.

If desired, no drive need be provided for the displacement of the bulkhead partition, in which case its guide rollers are arranged with increased friction, for example by providing a pawl or friction coupling, so that the displacement of the bulkhead partition by the pressure of the loaded waste material encounters increased resistance. In this case, the bulkhead partition would be displaced automatically with the movement of the conveyor band arrangement as the box car is loaded and it would be returned manually to its starting position. Also, the box need not be open at the bottom but the conveyor band arrangement of the present invention may be arranged on the bottom of a conventional box car open at the top.

What is claimed is:

1. A box car for storing bulk material and useful for incorporation in a freight train preceding a ballast cleaning machine for transporting waste material coming from the machine, the box car comprising a frame defining a plane, a box open on top and at the bottom, the box being mounted on the frame for storing the bulk material and having fixed input and output ends for respectively charging the bulk material into the box and discharging the bulk material from the box, a conveyor band arrangement forming a bottom wall of the box immediately below the open bottom and extending in the direction of elongation of the box car, the conveyor band arrangement having a width substantially equal to that of the lower box portion and comprising a first portion adjacent the input end and extending in the plane, the first portion being arranged to receive the bulk material charged into the box at the fixed input end, and an ascending portion extending in said direction from the first portion of the conveyor band arrangement and projecting beyond the output end, a drive means for the conveyor band arrangement, a bulkhead partition extending in the box transversely to said direction, the bulkhead partition being arranged above the first portion of the conveyor band arrangement, and means for displaceably moving said bulkhead partition in said direction for dividing the box into compartments, the bulkhead partition having a lower end fixedly spaced from the first conveyor band arrangement portion to define a port therewith.

2. The box car of claim 1, wherein the two portions are constituted by a single conveyor band.

3. The box car of claim 1, wherein the open box bottom has an obliquely ascending end portion extending in said direction to an upper edge of the box at the output end and the ascending conveyor band arrangement portion forms a bottom wall of the ascending open box bottom end portion.

4. The box car of claim 3, wherein an end portion of the open box bottom and of the conveyor band arrangement at the input end forms short portions descending to said plane to provide a gliding zone for the bulk material.

5. The box car of claim 1, wherein the box has two side walls extending in said direction, and further comprising respective guide rails along the side walls and at least two guide rollers running along each one of the guide rails for displacing the bulkhead partition.

6. The box car of claim 1, wherein the two conveyor band arrangement portions are constituted by two conveyor bands overlapping adjacent the output end.

7. The box car of claim 6, wherein one of the conveyor bands and a portion of the other conveyor band subtending the one conveyor band are arranged immediately below the open bottom and form the bottom wall of the box.

8. The box car of claim 6, wherein one of the conveyor bands has an end overlapping a subtending end of the other conveyor band, the other conveyor band constituting the ascending portion adjacent the subtending end, and further comprising a pivot extending perpendicularly to the plane for rotatably mounting the subtending conveyor band end on the frame.

9. The box car of claim 6, wherein the drive means for the conveyor band arrangement comprises a respective hydraulic drive for each one of the conveyor bands.

10. The box car of claim 9, further comprising longitudinal guide means for the displacement of the bulkhead partition, a hydraulic drive for displacing the bulkhead partition along the guide means, and a common hydraulic source connected to the conveyor band and bulkhead partition drives.

11. The box car of claim 1 and incorporated in a freight train wherein successive ones of the box cars are coupled together with their respective input and output ends facing each other, the ascending portion of the conveyor band arrangement projecting from the output end of a preceding one of the successive box cars leading to the input end of a succeeding one of the successive box cars whereby the conveyor band arrangements of the successive box cars form a continuous conveyor path.

12. The box car of claim 1, wherein the speed of displacement of the bulkhead partition is synchronized with the speed of drive means for the conveyor band arrangement.

13. The box car of claim 6 and incorporated in a freight train wherein successive ones of the box cars are coupled together with their respective input and output ends facing each other, the ascending portion of the conveyor band arrangement projecting from the output end of a preceding one of the successive box cars leading to the input end of a succeeding one of the successive box cars whereby the conveyor band arrangements of the successive box cars form a continuous conveyor path.

14. The box car of claim 6, wherein the speed of displacement of the bulkhead partition is synchronized with the speed of drive means for the conveyor band arrangement.

* * * * *